US006997095B1

(12) United States Patent
Kishi et al.

(10) Patent No.: US 6,997,095 B1
(45) **Date of Patent: *Feb. 14, 2006**

(54) APPARATUS AND METHOD FOR MAKING LABELS

(75) Inventors: Motoshi Kishi, Nagoya (JP); Tadanobu Chikamoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 184 days.

This patent is subject to a terminal disclaimer.

(21) Appl. No.: 09/661,778

(22) Filed: Sep. 14, 2000

(30) Foreign Application Priority Data

Sep. 16, 1999 (JP) ..... 11-261688

(51) Int. Cl.
*B26D 3/08* (2006.01)
*B26D 3/10* (2006.01)
*B26D 7/26* (2006.01)

(52) U.S. Cl. ..... 83/881; 83/76.1; 83/433; 83/699.61; 83/879; 83/886

(58) Field of Classification Search ..... 83/34, 83/56, 578, 614, 640, 698.61, 699.41, 699.61, 83/862, 863, 879–882, 886, 887, 76.1, 76.6, 83/407, 433, 582
See application file for complete search history.

(56) References Cited

U.S. PATENT DOCUMENTS

| | | | | |
|---|---|---|---|---|
| 4,391,168 | A * | 7/1983 | Gerber et al. | 83/56 X |
| 4,524,894 | A * | 6/1985 | Leblond | 225/96 X |
| 4,608,891 | A * | 9/1986 | Frisby et al. | 83/881 X |
| 4,624,169 | A * | 11/1986 | Nelson | 83/881 |
| 4,920,495 | A * | 4/1990 | Pilkington | 83/862 X |
| 5,038,654 | A * | 8/1991 | Mackey | 83/881 X |
| 5,056,295 | A * | 10/1991 | Williams | 83/640 X |
| 6,341,548 | B1 * | 1/2002 | Hirahata et al. | 83/881 |

FOREIGN PATENT DOCUMENTS

| | | |
|---|---|---|
| DE | 195 21 604 C1 | 4/1997 |
| EP | 0 956 930 A2 | 11/1999 |
| GB | 2 313 081 A | 11/1997 |
| JP | 2-14952 | 4/1990 |

* cited by examiner

*Primary Examiner*—Clark F. Dexter
(74) *Attorney, Agent, or Firm*—Oliff & Berridge, PLC

(57) ABSTRACT

A label making apparatus includes a cutter that cuts sheets along a desired line, the cutter being switchable between a full cutting state and a half cutting state. A controller controls a switching device to switch the cutter between the full cutting state and the half cutting state. A method of making labels includes performing the half cutting on the sheet at least twice before performing the full cutting.

3 Claims, 17 Drawing Sheets

Fig. 16

| | | | | | | |
|---|---|---|---|---|---|---|
| P | 00 | 00 | 00 | 00 | 00 | 00 |
| P | 00 | 00 | 00 | 00 | 00 | 00 |
| P | 00 | 00 | 00 | 00 | 00 | 00 |
| P | 04 | 1C | 1C | 1C | 1C | 10 |
| P | 04 | 22 | 22 | 22 | 22 | 10 |
| P | 04 | 22 | 22 | 22 | 22 | 10 |
| P | 04 | 22 | 22 | 22 | 22 | 10 |
| P | 04 | 22 | 22 | 22 | 22 | 10 |
| P | 04 | 22 | 22 | 22 | 22 | 10 |
| P | 04 | 22 | 22 | 22 | 22 | 10 |
| P | 04 | 22 | 22 | 22 | 22 | 10 |
| P | 04 | 1C | 1C | 1C | 1C | 10 |
| P | 00 | 00 | 00 | 00 | 00 | 00 |
| P | 00 | 00 | 00 | 00 | 00 | 00 |
| P | 00 | 00 | 00 | 00 | 00 | 00 |
| H | 00 | 00 | 0F | | | |
| P | 00 | 00 | 00 | 00 | 00 | 00 |
| P | 00 | 00 | 00 | 00 | 00 | 00 |
| P | 00 | 00 | 00 | 00 | 00 | 00 |
| P | 0E | 1C | 1C | 1C | 1C | 10 |
| P | 11 | 22 | 22 | 22 | 22 | 10 |
| P | 10 | 22 | 22 | 22 | 22 | 10 |
| P | 10 | 22 | 22 | 22 | 22 | 10 |
| P | 08 | 22 | 22 | 22 | 22 | 10 |
| P | 04 | 22 | 22 | 22 | 22 | 10 |
| P | 02 | 22 | 22 | 22 | 22 | 10 |
| P | 01 | 22 | 22 | 22 | 22 | 10 |
| P | 1F | 1C | 1C | 1C | 1C | 10 |
| P | 00 | 00 | 00 | 00 | 00 | 00 |
| P | 00 | 00 | 00 | 00 | 00 | 00 |
| P | 00 | 00 | 00 | 00 | 00 | 00 |
| H | 00 | 00 | 1E | | | |
| P | 00 | 00 | 00 | 00 | 00 | 00 |
| P | 00 | 00 | 00 | 00 | 00 | 00 |
| P | 00 | 00 | 00 | 00 | 00 | 00 |
| P | 0E | 1C | 1C | 1C | 1C | 10 |
| P | 11 | 22 | 22 | 22 | 22 | 10 |
| P | 10 | 22 | 22 | 22 | 22 | 10 |
| P | 10 | 22 | 22 | 22 | 22 | 10 |
| P | 0E | 22 | 22 | 22 | 22 | 10 |
| P | 10 | 22 | 22 | 22 | 22 | 10 |
| P | 10 | 22 | 22 | 22 | 22 | 10 |
| P | 11 | 22 | 22 | 22 | 22 | 10 |
| P | 0E | 1C | 1C | 1C | 1C | 10 |
| P | 00 | 00 | 00 | 00 | 00 | 00 |
| P | 00 | 00 | 00 | 00 | 00 | 00 |
| P | 00 | 00 | 00 | 00 | 00 | 00 |
| H | 00 | 00 | 2D | | | |
| P | 00 | 00 | 00 | 00 | 00 | 00 |
| P | 00 | 00 | 00 | 00 | 00 | 00 |
| P | 00 | 00 | 00 | 00 | 00 | 00 |

⋮

| | | | | | | |
|---|---|---|---|---|---|---|
| P | 00 | 00 | 00 | 00 | 00 | 00 |
| P | 00 | 00 | 00 | 00 | 00 | 00 |
| P | 00 | 00 | 00 | 00 | 00 | 00 |
| H | 00 | 00 | 69 | | | |
| P | 00 | 00 | 00 | 00 | 00 | 00 |
| P | 00 | 00 | 00 | 00 | 00 | 00 |
| P | 00 | 00 | 00 | 00 | 00 | 00 |
| P | 0E | 1C | 1C | 1C | 1C | 10 |
| P | 11 | 22 | 22 | 22 | 22 | 10 |
| P | 11 | 22 | 22 | 22 | 22 | 10 |
| P | 11 | 22 | 22 | 22 | 22 | 10 |
| P | 0E | 22 | 22 | 22 | 22 | 10 |
| P | 11 | 22 | 22 | 22 | 22 | 10 |
| P | 11 | 22 | 22 | 22 | 22 | 10 |
| P | 11 | 22 | 22 | 22 | 22 | 10 |
| P | 0E | 1C | 1C | 1C | 1C | 10 |
| P | 00 | 00 | 00 | 00 | 00 | 00 |
| P | 00 | 00 | 00 | 00 | 00 | 00 |
| P | 00 | 00 | 00 | 00 | 00 | 00 |
| H | 00 | 00 | 78 | | | |
| P | 00 | 00 | 00 | 00 | 00 | 00 |
| P | 00 | 00 | 00 | 00 | 00 | 00 |
| P | 00 | 00 | 00 | 00 | 00 | 00 |
| P | 0E | 1C | 1C | 1C | 1C | 10 |
| P | 11 | 22 | 22 | 22 | 22 | 10 |
| P | 11 | 22 | 22 | 22 | 22 | 10 |
| P | 11 | 22 | 22 | 22 | 22 | 10 |
| P | 0E | 22 | 22 | 22 | 22 | 10 |
| P | 10 | 22 | 22 | 22 | 22 | 10 |
| P | 10 | 22 | 22 | 22 | 22 | 10 |
| P | 10 | 22 | 22 | 22 | 22 | 10 |
| P | 0E | 1C | 1C | 1C | 1C | 10 |
| P | 00 | 00 | 00 | 00 | 00 | 00 |
| P | 00 | 00 | 00 | 00 | 00 | 00 |
| P | 00 | 00 | 00 | 00 | 00 | 00 |
| H | 00 | 00 | 87 | | | |

APPARATUS AND METHOD FOR MAKING LABELS

BACKGROUND OF THE INVENTION

1. Field of the Invention

The invention relates to an apparatus and method for making labels and for performing a plurality of half cuttings on a sheet before performing a full cutting, using one cutter.

2. Description of the Related Art

Label making apparatuses for processing a laminated tack sheet of an adhesive sheet and a releasable sheet are known. In such a label making apparatus, a rolled sheet unit that supports the sheet wound around a core is detachably attachable. The label making apparatus includes a transport roller for pulling out the sheet from the rolled sheet unit and transporting the sheet and a cutting mechanism that cuts the sheet transported by the transport roller.

The cutting mechanism generally includes a cutter that cuts the sheet, and a carriage that reciprocates the cutter in a direction substantially perpendicular to a sheet transport direction (a width direction of the sheet). Therefore, by normal and reverse rotation of the transport roller and the reciprocation of the carriage in the width direction of the sheet, the cutter can be placed at any position on the sheet and cut the sheet into a predetermined shape.

There is a label making apparatus capable of cutting the sheet in two different manners. One manner is a half cutting in which the sheet is cut partway in a direction of a thickness of the sheet, for example, only the adhesive sheet or the releasable sheet of the sheet is cut. Another manner is a full cutting in which the sheet is completely cut in the direction of the thickness of the sheet. Further, there is a label making apparatus provided with two cutters in which one cutter is for the half cutting and the other cutter is for the full cutting. Furthermore, a label making apparatus that can perform both the half cutting and the full cutting using one cutter exists, as disclosed in Japanese Utility Model Publication No. 2-14952.

However, the currently known label making apparatus that can perform both the half cutting and full cutting on a sheet using one cutter cannot perform a plurality of half cuttings on the sheet before performing the full cutting. Therefore, a plurality of labels made using such a label making apparatus are separated into pieces by a full cutting. Because of this, it becomes extremely inconvenient to handle these labels when printed contents of the labels are related to each other, such as when the labels are serially numbered.

On the other hand, in the label making apparatuses provided with two cutters in which one cutter is for half cutting and the other cutter is for full cutting, there is a label making apparatus that can perform a plurality of half cuttings before performing a full cutting on a sheet. However, in this case, the label making apparatus has two cutters, so that a structure of the apparatus becomes complicated. Further, the full cutting and the half cutting are performed at a different position, so that, for example, the sheet needs to be stopped at an appropriate position when any cutting is performed. Accordingly, a control of the apparatus also becomes complicated.

Japanese Utility Model Publication No. 2-14952 discloses a label making apparatus that can perform both the half cutting and the full cutting using one cutter. However, the label making apparatus is provided with an electric drive, such as a solenoid, in a cutting unit to adjust a vertical position of the cutter. Therefore, the structure of the label making apparatus is complicated.

A simple structure label making apparatus having one cutter that can make a plurality of labels which are easy to handle has not known yet been developed.

SUMMARY OF THE INVENTION

According to the invention, an apparatus and method for making labels are provided which can make a plurality of labels which are easy to handle using one cutter with a simple structure.

Further, according to the invention, an apparatus and method for making labels are provided which can switch a state of the one cutter back and forth between a full cutting state and a half cutting state with a simple structure.

In various exemplary embodiments of the invention, a label making apparatus that makes labels by performing a full cutting and a half cutting on a sheet includes a cutter that cuts the sheet along a desired line, a switching device that switches a state of the cutter capable of performing the full cutting and the half cutting on the sheet between a full cutting state and a half cutting state, and a controller that controls the switching device so that the half cutting is performed at least twice on the sheet before the full cutting is performed thereon.

Further, a label making method for making labels by performing a full cutting and a half cutting on a sheet using one cutter capable of selectively performing the full cutting and the half cutting includes repeatedly half cutting on the sheet along desired lines and transporting the sheet until the predetermined number of half cut lines are formed on the sheet, switching a state of the cutter to a full cutting state in which the cutter can perform the full cutting on the sheet, and full cutting the sheet along a desired line using the cutter.

With this arrangement, before a full cutting is performed on a sheet, a half cutting is performed at least twice. Therefore, when making a plurality of labels whose printed contents are related to each other, such as serially numbered labels, the labels do not come apart. Consequently, a strip of labels that is convenient to handle can be obtained. Further, a strip of labels including a plurality of labels that are continuously connected to each other by half cut lines without wasted portions therebetween can be obtained. Therefore, the sheet can be prevented from being wasted.

Further, the label making apparatus performs the full cutting and the half cutting using one cutter by switching the state of the cutter. Therefore, only one drive source is needed, so that the structure of the label making apparatus can be simplified. In addition, the full cutting and the half cutting are performed at the same position, so that the control, such as stopping the sheet when cutting, can be performed with relative ease.

In various exemplary embodiments of the invention, the cutter can be supported by a self-propelled cutting unit, the state of the cutter can be switched between the full cutting state and the half cutting state at ends of a traveling path of the self-propelled cutting unit, the switching device can achieve one of the full cutting state and the half cutting state at least two positions, and the two positions that achieve one of the states exist on both sides of a position that achieves another state. Switching of the state of the cutter between the full cutting state and the half cutting state can be performed, for example, by directly bumping the self-propelled cutting unit against a wall at the end of the traveling path.

With this arrangement, the state of the cutter can be switched between the full cutting state and the half cutting state at the ends of the traveling path of the self- propelled cutting unit supporting the cutter. Therefore, the state of the cutter can be easily switched back and forth between the full cutting state and the half cutting state by a drive source for moving the cutting unit, without providing an electric drive, such as a solenoid.

Further, because the two positions that achieve one of the states exist on both sides of a position that achieves the other state, the cutting unit does not need to be unnecessarily moved only for switching from one state to the other state. Furthermore, when switching from one state to another state, the cutting unit also does not need to be moved only to switch the state. Therefore, a time involved in making a label can be reduced.

In various exemplary embodiments of the invention, the switching device can achieve the full cutting state at least two positions and two positions that achieve the full cutting state exist on both sides of the position that achieve the half cutting state.

With this arrangement, two positions that achieve the full cutting state exist on both sides of the position that achieves the half cutting state, so that a time involved in making a label can be reduced. Further, the half cutting state, which requires fine dimension control of the amount of protrusion of the cutter, can be achieved at one position, so that variation in depth of the half cuttings does not occur and the depth of the half cutting can be always maintained constant.

In various exemplary embodiments of the invention, a label making method includes changing the position that achieves the one state from one of two positions to another position while the full cutting or the half cutting is not performed on a sheet.

According to this, by changing the position that achieves the one state from one of two positions to another position, switching from one state to another state can be achieved by bumping the cutting unit at the end of the traveling path without the need to run the cutting unit unnecessarily. Therefore, time in making a label can be saved.

Further, the cutting unit does not need to be unnecessarily moved, so that a mechanism, such as the solenoid, that lifts the cutting unit is unnecessary. Therefore, the structure of the label making apparatus can be simplified.

BRIEF DESCRIPTION OF THE DRAWINGS

Various exemplary embodiments of the invention will be described in detail with reference to the following figures wherein:

FIG. 16 illustrates contents of data to be used for making the labels of FIG. 15;

DETAILED DESCRIPTION OF EXEMPLARY EMBODIMENTS

Various exemplary embodiments of the invention will be described with reference to the accompanying drawings.

Figure 1:
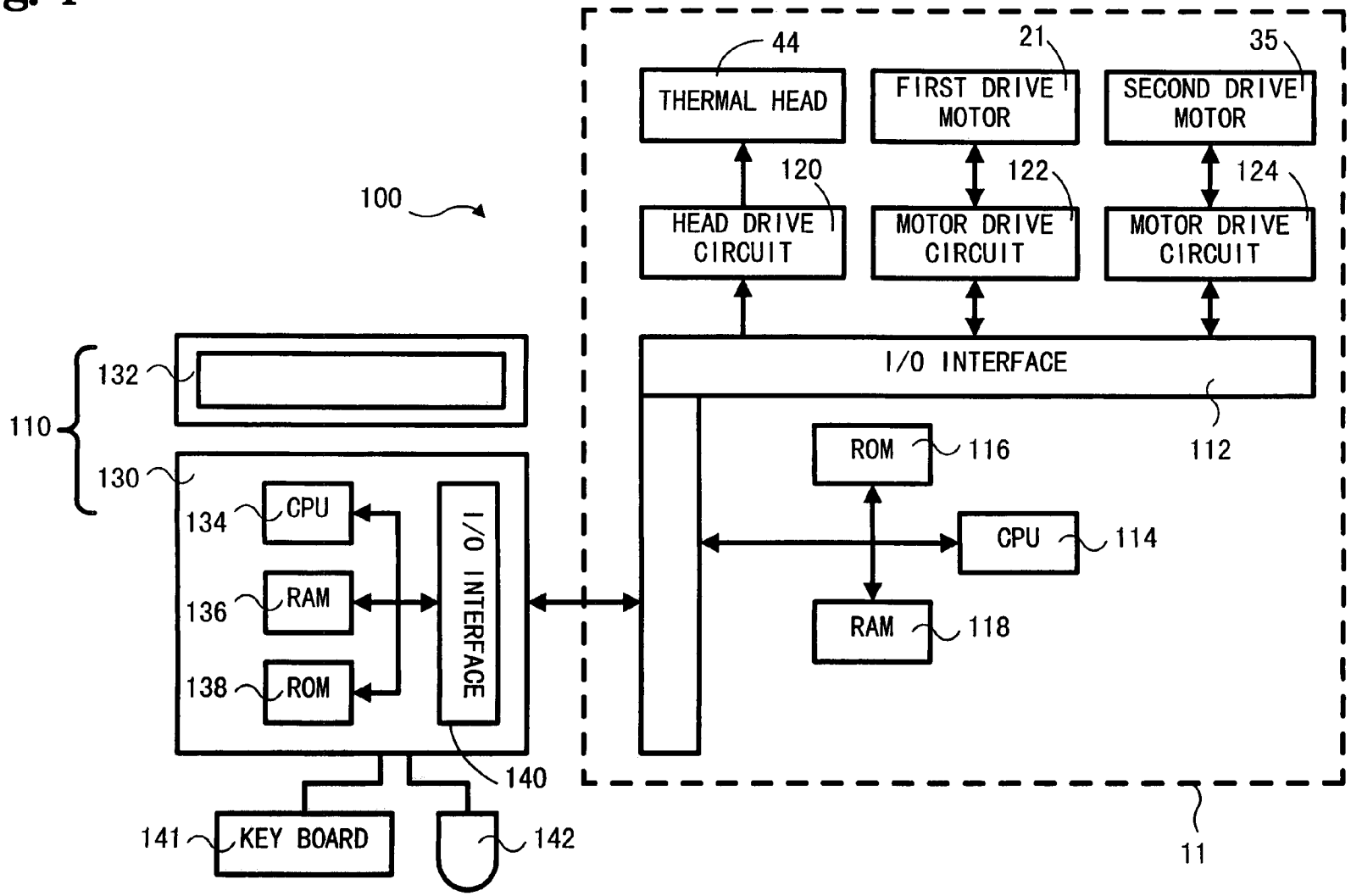
FIG. 1 is a block diagram of a label making apparatus according to an exemplary embodiment of the invention.
Figure 2:
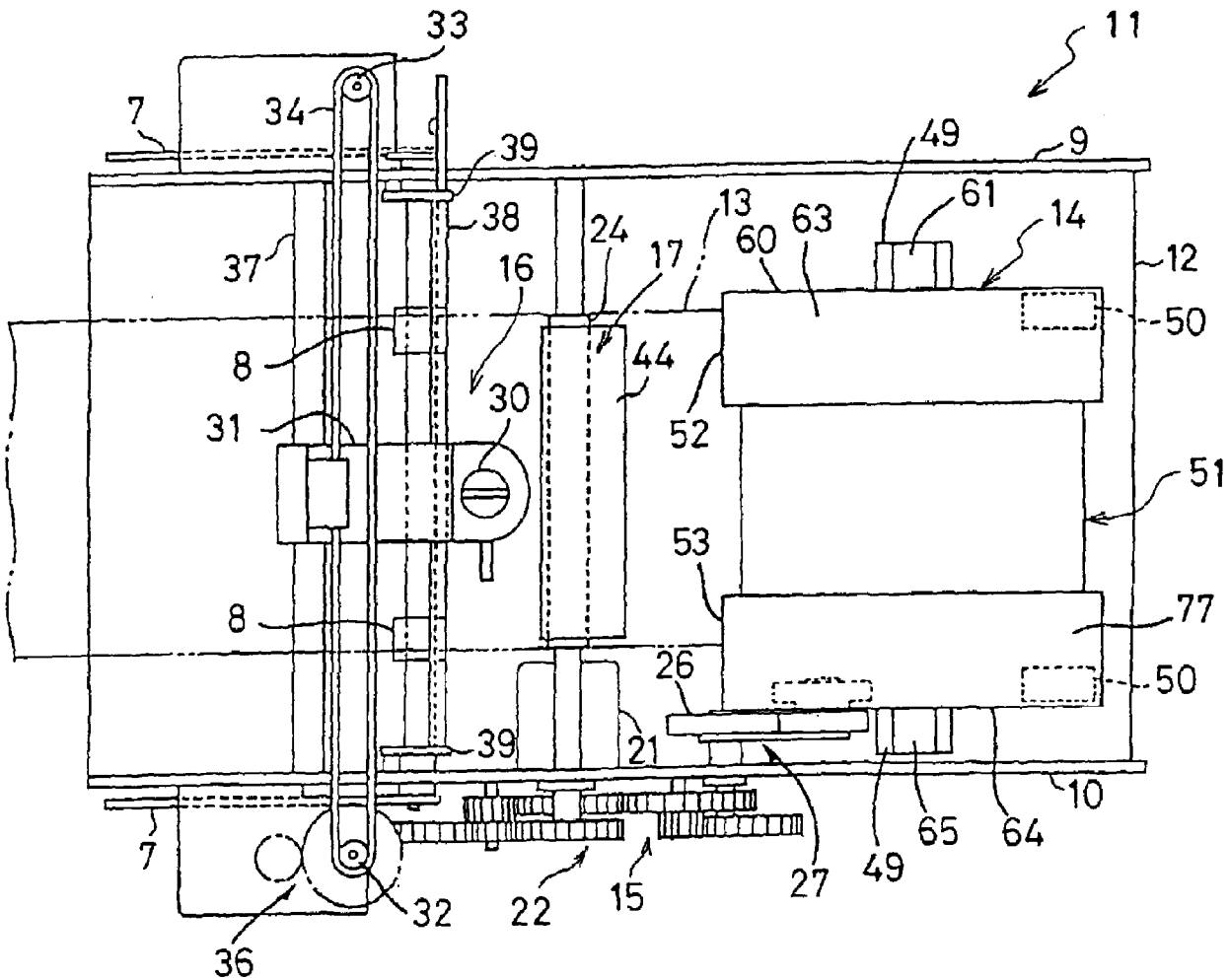
FIG. 2 is a plan view showing a main structure of a cutting printer shown in FIG. 1.
Figure 3:
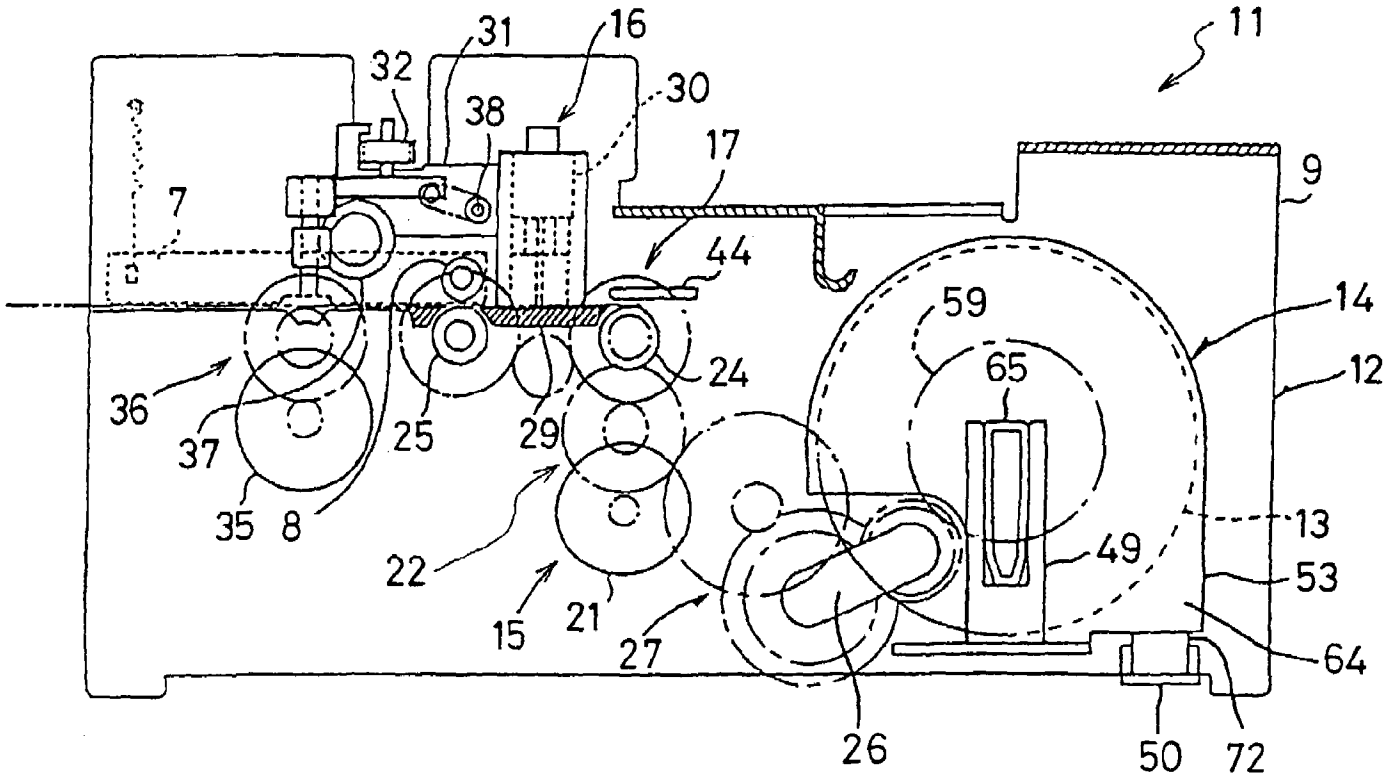
FIG. 3 is a sectional view of the cutting printer shown in FIG. 1.
Figure 4:
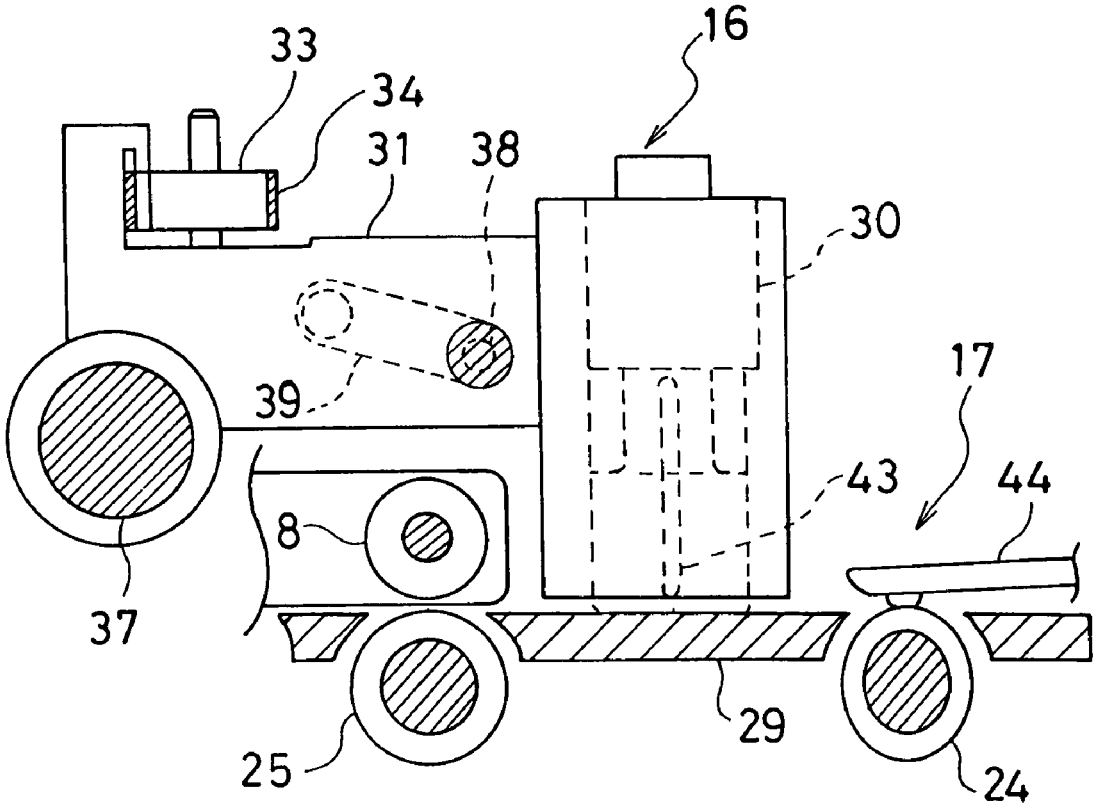
FIG. 4 is a side sectional view of a cutting mechanism of the cutting printer shown in FIG. 1.
Figure 5:
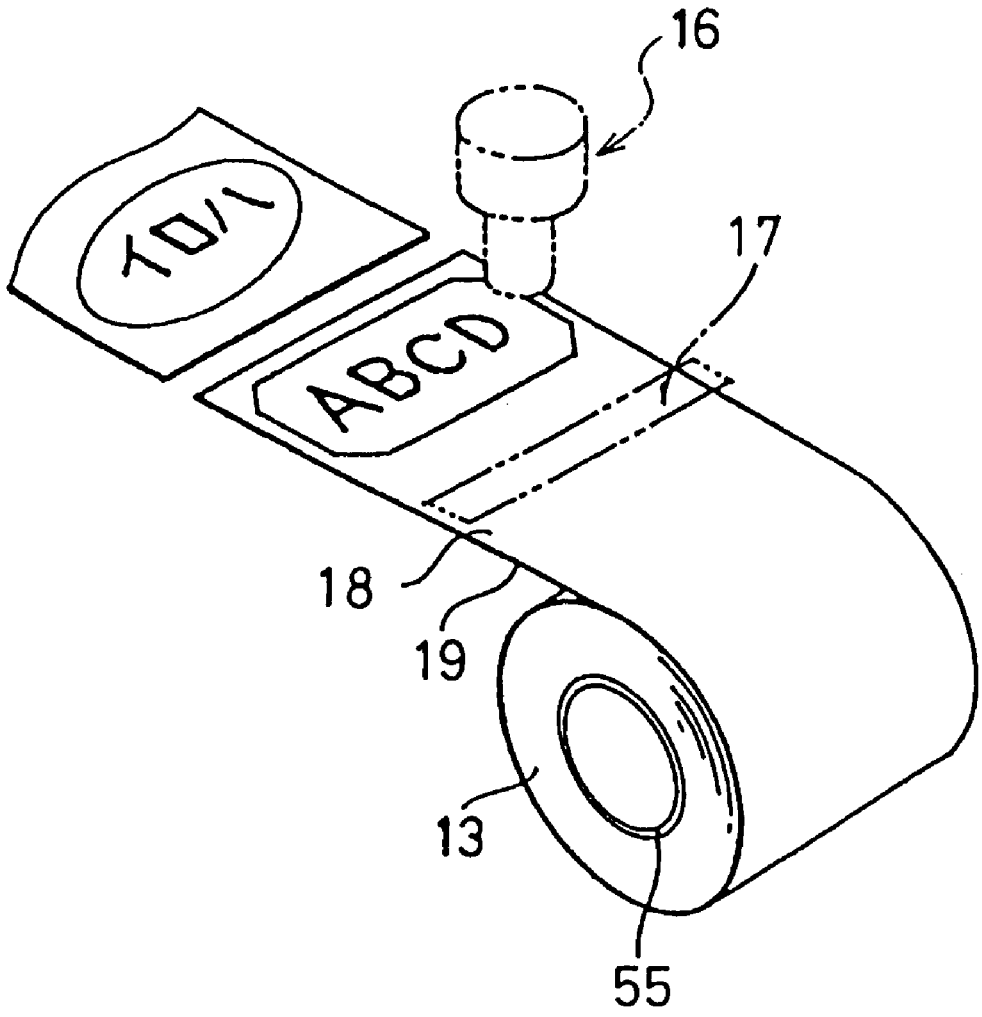
FIG. 5 is a schematic perspective view showing a positional relationship between a rolled sheet unit, the cutting mechanism and an image forming mechanism in the cutting printer shown in FIG. 1.

A label making apparatus 100 of the embodiment shown in FIG. 1 includes a sheet processing device (hereinafter referred to as a cutting printer) 11 and a personal computer 110. First, a structure of the cutting printer 11 will be described. FIG. 2 is a plan view showing a main structure of the cutting printer 11 in a label making apparatus according to an embodiment of the invention. FIG. 3 is a sectional view of the cutting printer 11 of FIG. 2. FIG. 4 is a side sectional view of a cutting mechanism of the cutting printer 11 of FIG. 2. FIG. 5 is a schematic perspective view showing a positional relationship between a rolled sheet unit, the cutting mechanism, and an image forming mechanism.

The cutting printer 11 shown in FIGS. 2 and 3 includes a frame 12 having side walls 10 and 9 which are disposed at its right and left sides, respectively. Provided within the frame 12 of the cutting printer 11 are a rolled sheet unit 14, a transport mechanism 15, a cutting mechanism 16, and an image forming mechanism 17. The rolled sheet unit 14 rotatably supports a tack sheet 13 which is wound in a roll shape. The transport mechanism 15 transports the tack sheet 13 in a forward and reverse direction. The cutting mechanism 16 cuts the tack sheet 13 transported by the transport mechanism 15. The image forming mechanism 17 is disposed upstream from the cutting mechanism 16 with respect to the transport of the tack sheet 13 in the forward direction (in a discharge direction).

As shown in FIGS. 2 and 5, a rolled sheet 51 is formed by which the tack sheet 13 is wound around a cylindrical-shaped core 55 in a roll shape. The tack sheet 13 includes two layers, an adhesive sheet 18 and a releasable sheet 19. A surface of the adhesive sheet 18 is printable and its opposite surface has an adhesive applied thereto. The releasable sheet 19 is adhered to the opposite surface of the adhesive sheet 18.

First, the transport mechanism 15 will be described. As shown in FIG. 3, the transport mechanism 15 includes a platen roller 24, which is also an element of the image forming mechanism 17, and a discharge roller 25 disposed downstream of the cutting mechanism 16. At a position opposed to the discharge roller 25, a following roller 8 is disposed so as to sandwich the tack sheet 13 therebetween. The following roller 8 is supported by a pressing plate 7 that urges the following roller 8 toward the discharge roller 25 side. By the normal and reverse rotation of a first drive motor 21 disposed within the frame 12, the platen roller 24 and the discharge roller 25 are rotated so as to transport the tack sheet 13 in the forward and reverse direction via a first gear train 22.

Further, the driving from the first drive motor 21 is transmitted to a gear 59 provided to a flange (not shown) of the rolled sheet unit 14, via a second gear train 27, including a planet gear mechanism 26. The planet gear mechanism 26 engages the gear 59 only when the tack sheet 13 is transported in the reverse direction, and does not engage the gear 59 when the tack sheet 13 is transported in the forward direction. Therefore, when the tack sheet 13 is transported in the forward direction, the rolled sheet 51 is rotated by a force of pulling the tack sheet 13 out by the rotation of the platen roller 24 and the discharge roller 25. On the other hand, when the tack sheet 13 is transported in the reverse direction, the rolled sheet 51 is rotated in the reverse direction by the driving of the first drive motor 21.

Next, the cutting mechanism 16 will be described. The cutting mechanism 16 includes a cutting bed 29, a self-propelled cutting unit 30, and a carriage 31. The cutting bed 29 receives the tack sheet 13 at the lower position of the cutting mechanism 16. The self-propelled cutting unit 30 is opposed to the cutting bed 29, sandwiching the tack sheet 13 therebetween. The cutting unit 30 is detachably attached to the carriage 31. At a position opposed to the cutting unit 30, a slit is formed in the cutting bed 29 in a width direction of the cutting bed 29, so that a tip of a cutter 43 can penetrate thereinto.

As shown in FIG. 2, the carriage 31 is connected to one portion of an endless timing belt 34. The timing belt 34 is wound between a pair of pulleys 32 and 33 which are disposed outside of both side walls 9 and 10 of the frame 12. As shown in FIG. 3, the pulley 32 is driven by the second motor 35 disposed outside the side wall 10 of the frame 12, via a third gear train 36, including, for example, a bevel gear. Thus, the carriage 31 reciprocates in a direction substantially perpendicular to the transport direction of the tack sheet 13 (in the width direction of the sheet).

As shown in FIG. 4, a main guide shaft 37 supported by the side walls 9 and 10 penetrates through the end opposed to the end where the cutting unit 30 is attached. The carriage 31 is slidably supported by the main guide shaft 37. An auxiliary guide shaft 38 that extends in substantially parallel to the main guide shaft 37 slidably penetrates through a portion between the end where the cutting unit 30 is attached and the end where the main guide shaft 37 penetrates though. Both ends of the auxiliary guide shaft 38 are supported by a pair of rotation arms 39 rotatably provided on both side walls 9 and 10 of the frame 12.

The lower end of the cutting unit 30 is urged by an urging force from a spring (not shown) to press against the upper surface of the cutting bed 29.

As shown in FIGS. 2 and 3, the image forming mechanism 17 includes a line thermal head 44 and the platen roller 24. The thermal head 44 is a print head and has a length substantially equal to the width of the tack sheet 13. The platen roller 24 is opposed to the thermal head 44, sandwiching the tack sheet 13 therebetween.

Figure 6:
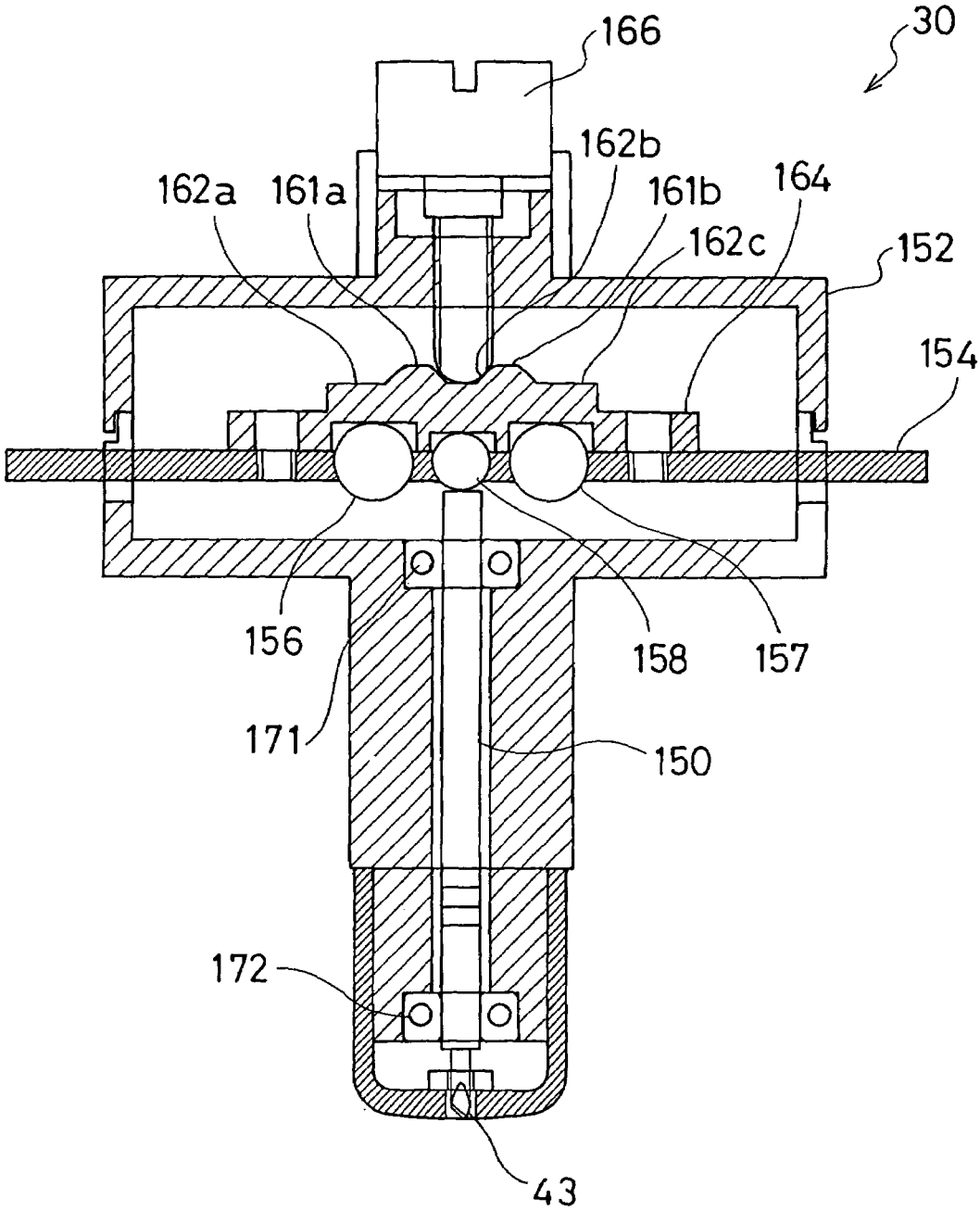
FIG. 6 is a sectional view of a cutting unit in a half cutting state in the cutting printer shown in FIG. 1.
Figure 7:
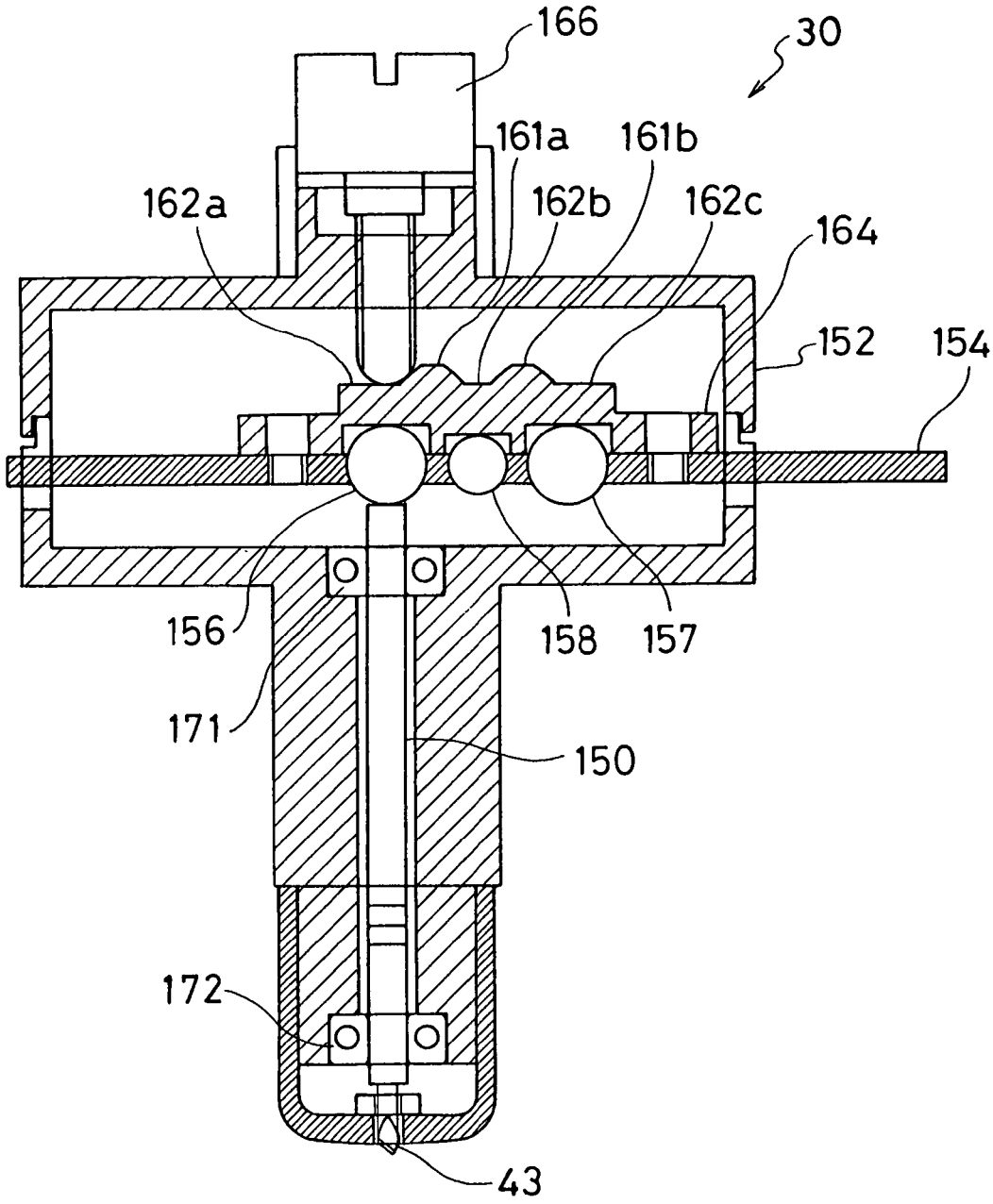
FIG. 7 is a sectional view of the cutting unit in a full cutting state in the cutting printer shown in FIG. 1.
Figure 8:
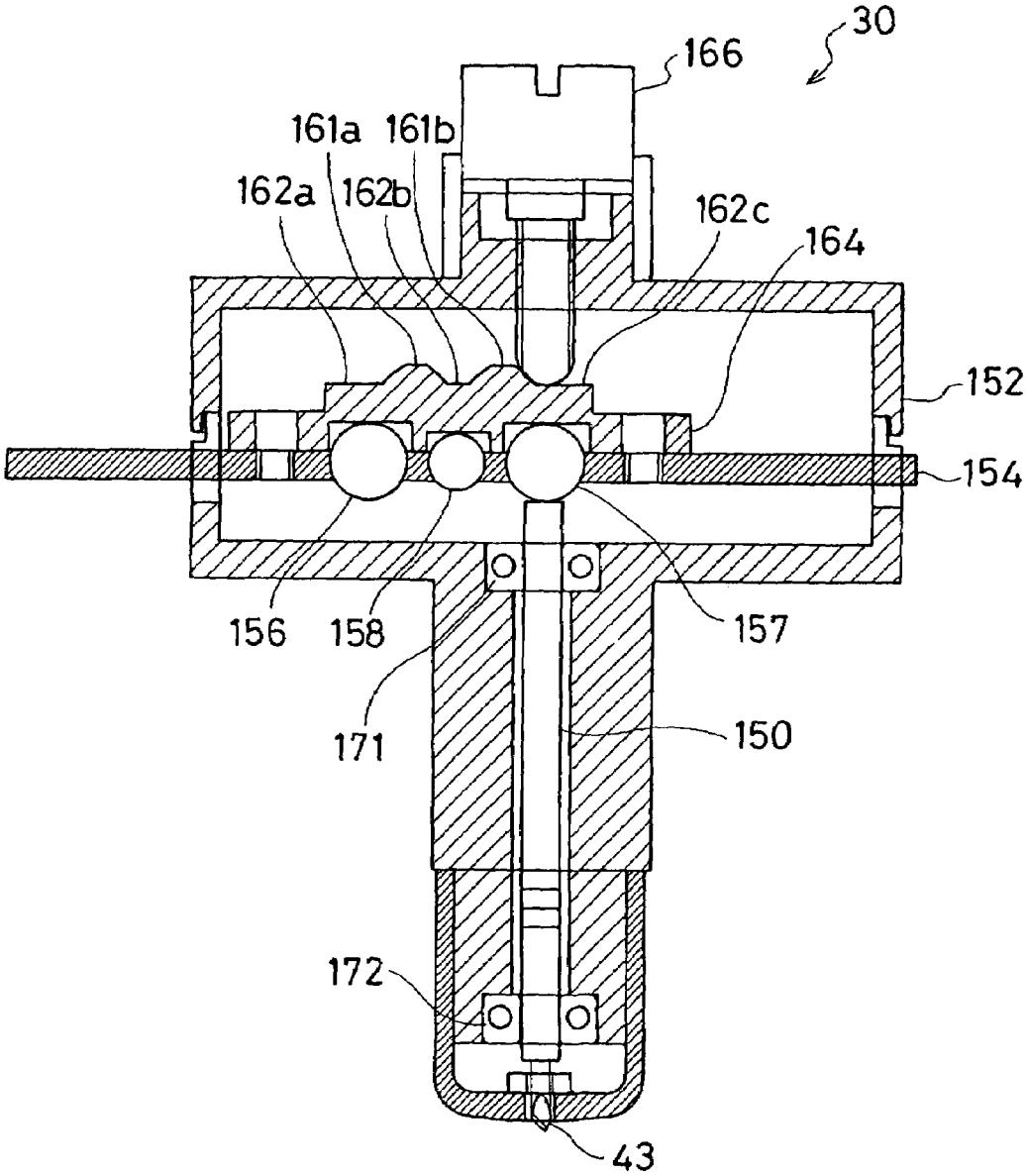
FIG. 8 is a sectional view of the cutting unit in the full cutting state in the cutting printer shown in FIG. 1.

Next, a structure of the cutting unit 30 of the cutting mechanism 16 will be described. The label making apparatus 100 is structured to cut the tack sheet 13 by the cutting unit 30 in two different states. One is a half cutting state in which the cutting unit 30 can cut the tack sheet 13 partway in a direction of a thickness of the tack sheet 13, for example, the cutting unit 30 cuts only the adhesive sheet 18 or the releasable sheet 19 of the tack sheet 13. Another is a full cutting state in which the cutting unit 30 can completely cut the tack sheet 13 in the direction of the thickness of the sheet. FIG. 6 is a sectional view of the cutting unit 30 in the half cutting state. FIGS. 7 and 8 are sectional views of the cutting unit 30 in the full cutting state. In FIGS. 6 through 8, it is assumed that the walls 9 and 10 exist right and left, respectively, outside the drawings. As shown in FIGS. 6 through 8, the cutting unit 30 has one cutter (cutting blade) 43 for cutting the tack sheet 13, at the lower end of a housing 152. The cutter 43 is upwardly urged by a spring mechanism (not shown) and is supported by a cutter supporting portion 150. The upper end and lower end of the cutter supporting portion 150 are supported by radial bearings 171 and 172, respectively, so that the cutter supporting portion 150 can move up and down and rotate about its axis.

A flat plate shaped lever 154 in which three holes are formed is provided above the cutter supporting portion 150. Two large-diameter balls 156 and 157, which both have the same diameter, and one small-diameter ball 158 are inserted in the respective holes formed in the lever 154. The lever 154 has a length that its ends can protrude from right and left side walls of the housing 152 of the cutting unit 30, and is upwardly urged by a spring (not shown). A cover 164 has two projections 161*a*, 161*b* and three flat portions 162*a*, 162*b*, 162*c* on its upper surface and is fastened to the upper surface of the lever 154.

The small-diameter ball 158 is disposed between the large-diameter balls 156 and 157. The cover 164 is formed so that the flat portions 162*a* and 162*c* are positioned above the large-diameter balls 156 and 157, respectively, and the flat portion 162*b* is positioned above the small-diameter ball 158. A cutter adjustment screw 166 for adjusting the tip protrusion amount of the cutter 43 is provided at the upper end of the cutting unit 30. The cutter adjustment screw 166 is rotated to press the cover 164, thereby the tip protrusion amount of the cutter 43 is adjusted.

In the half cutting state shown in FIG. 6, the small-diameter ball 158 contacts the upper end of the cutter supporting portion 150 supporting the cutter 43. At this time, the tip protrusion amount of the cutter 43 is adjusted to cut only the adhesive sheet 18 of the tack sheet 13. Further, both ends of the lever 154 protrude from the housing 152.

In the full cutting state shown in FIG. 7, the large-diameter ball 156 contacts the upper end of the cutter supporting portion 150. In the full cutting state shown in FIG. 8, the large-diameter ball 157 contacts the upper end of the cutter supporting portion 150. At the time, the tip protrusion amount of the cutter 43 is adjusted to cut both the releasable sheet 19 and the adhesive sheet 18 of the tack sheet 13. In FIG. 7, only the right end of the lever 154 protrudes from the housing 152, and in FIG. 8, only the left end of the lever 154 protrudes from the housing 152. The protrusion amount of the lever 154 is larger than that in the half cutting state shown in FIG. 6. That is, in the full cutting state, the lever 154 bumps against either one of the side walls 9 or 10 at the position which is farther than the housing 152 is apart from either of the walls 9 or 10 in the half cutting state, and thus switching to the half cutting state is preformed.

Figure 9:
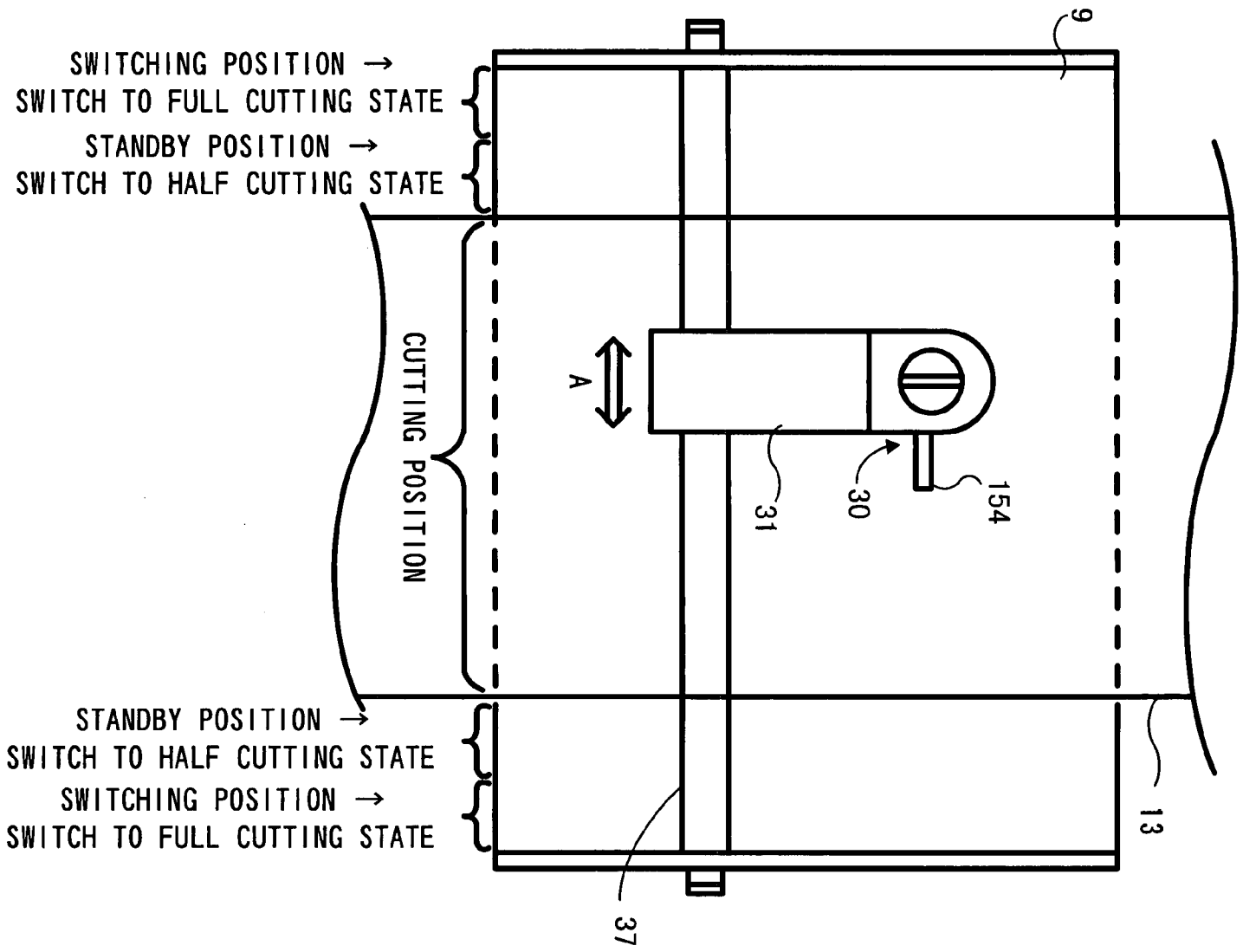
FIG. 9 is a schematic diagram of surroundings of the cutting unit in the cutting printer shown in FIG. 1.

Switching between the full cutting state and the half cutting state will be further described with reference to FIG. 9. FIG. 9 is a schematic diagram showing surroundings of the cutting unit. As shown in FIG. 9, the carriage 31 supported by the main guide shaft 37 can reciprocate between the walls 9 and 10 in a direction indicated with an arrow A. When the carriage 31 is positioned in a cutting position corresponding to the width of the tack sheet 13, the tack sheet 13 is full or half cut, depending on whether the cutter 43 is in the full cutting state or in the half cutting state.

To switch the state of the cutter 43 from the half cutting state shown in FIG. 6 to the full cutting state shown in FIG. 7, the cutting unit 30 is moved to a switching position adjacent to the side wall 10 side of the frame 12 by the carriage 31. The switching position is where the state of the cutter 43 is switched from the full cutting state. As a result, the lever 154 which has protruded toward the side wall 10 side is pressed is pressed by the side wall 10, so that the lever 154 retracts within the housing 152 and the small-diameter ball 158 positions the upper end of the cutter supporting portion 150. Thus, the cutter supporting portion 150 is moved upward by a distance equal to the difference in the radius of the large-diameter ball 156 and the small-diameter ball 158. According to this, the cutter 43 protrudes by the amount that can cut the releasable sheet 19 and the adhesive sheet 18.

As opposed to this, to switch the state of the cutter 43 from the half cutting state shown in FIG. 6 to the full cutting state shown in FIG. 8, the cutting unit 30 is moved to a switching position adjacent to the side wall 9 of the frame 12 by the carriage 31. Further, it is possible to switch the state of the cutter 43 back and forth between the full cutting state shown in FIG. 7 and the full cutting state shown in FIG. 8. To switch from the full cutting state shown in FIG. 7 to the full cutting state shown in FIG. 8, the cutting unit 30 is moved to the switching position adjacent to the side wall 9. To switch from the full cutting state shown in FIG. 8 to the full cutting state shown in FIG. 7, the cutting unit 30 is moved to the switching position adjacent to the side wall 10.

To switch the state of the cutter 43 from the full cutting state shown in FIG. 7 to the half cutting state shown in FIG. 6, the cutting unit 30 is moved to a standby position of the side wall 9 side of the frame 12. The standby position is where the state of the cutter 43 is switched from the full cutting state to the half cutting state and the cutting unit 30 waits to perform a full cutting or a half cutting. As a result, the lever 154 which has protruded toward the side wall 9 side is pressed, so that about half of the protruded amount of the lever 154 retracts within the housing 152, the lever 154 protrudes from the housing 152 toward the side wall 9 side by the amount of the lever 154 retracted, and the large-diameter ball 157 positions the upper end of the cutter supporting portion 150. Thus, the cutter supporting portion 150 is moved upward by a distance equal to the difference in the radius of the large-diameter ball 157 and the small-diameter ball 158. According to this, the cutter 43 protrudes the amount that the cutter 43 can cut only the adhesive sheet 18.

To switch the state of the cutter 43 from the full cutting state shown in FIG. 8 to the half cutting state shown in FIG. 6, the cutting unit 30 is moved to a standby position of the side wall 10 side of the frame 12. As a result, the lever 154 which has protruded toward the side wall 10 side is pressed, so that about half of the protruded amount of the lever 154 retracts within the housing 152, the lever 154 protrudes from the housing 152 toward the side wall 10 side by the amount of the lever 154 retracted, and the large-diameter ball 157 positions the upper end of the cutter supporting portion 150. Then, the cutter supporting portion 150 is moved upward by a distance equal to the difference in the radius of the large-diameter ball 157 and the small-diameter ball 158. According to this, the cutter 43 protrudes the amount that the cutter 43 can cut only the adhesive sheet 18.

As described above, the standby positions are provided on both sides of the cutting position and the switching positions are provided outside of each standby position. Accordingly, the full cutting and the half cutting can be arbitrarily switched and performed by moving the cutting unit 30 to a desired position.

In the embodiment, because two large-diameter balls 156 and 157 that achieve the full cutting state are provided on both sides of the small-diameter ball 158 that achieves the half cutting state, the switching from the half cutting state to the full cutting state can be performed anytime at either of the right and left switching positions shown in FIG. 9. As a result, the switching from the full cutting state to the half cutting state can be immediately performed at the nearest standby position when necessary. For example, even when the cutting unit 30 in the full cutting state shown in FIG. 7 is moved to the standby position of the side wall 10, the switching from the full cutting state to the half cutting state cannot be performed. However, before performing the switching, the cutting unit 30 is changed to the full cutting state shown in FIG. 8 and performs the full cutting. Then, the switching to the half cutting state can be performed by moving the cutting unit 30 to the standby position of the side wall 10.

Therefore, according to the embodiment, the cutting unit 30 does not need to be unnecessarily run to switch between the full cutting state and the half cutting state, so that a time involved in making a label can be reduced. Further, the structure of the cutting printer 11 can be simplified because it is unnecessary to use a solenoid that vertically moves the cutting unit 30 and lifts the cutter 43 so that the tip of the cutter 43 does not penetrate into the slit of the cutting bed 29 at the time of not cutting the tack sheet 13.

Further, in the embodiment, the half cutting state, which requires fine dimension control of the tip protrusion amount of the cutter 43, is achieved by only one small-diameter ball 158. Therefore, variation in the depth of the half cutting does not occur and the depth of the half cutting can be always maintained constant.

Figure 10:
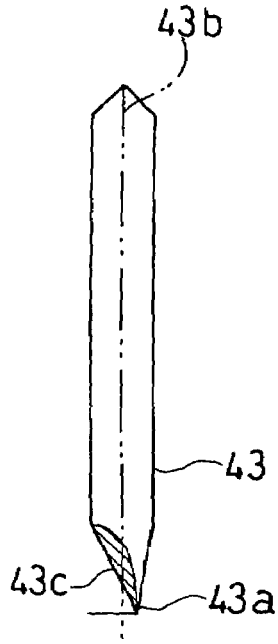
FIG. 10 is a front view of a cutter used in the cutting mechanism of the cutting printer shown in FIG. 1.

FIG. 10 is a front view of the cutter 43. As shown in FIG. 10, the tip 43*a* of the cutter 43 is eccentric to a center axis 43*b*. Therefore, when the cutter 43 is moved from side to side with the cutting unit 30 under a load in a direction of pressing the tack sheet 13, a cutting edge 43*c* always faces the direction of travel of the cutter 43. Consequently, the cutter 43 shown in FIG. 10 is particularly suited for cutting a curved line.

Figure 11A:
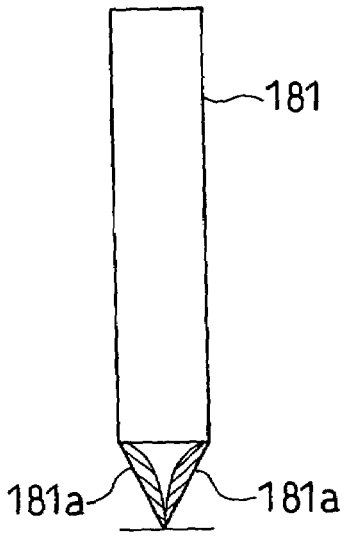
FIG. 11A is a front view showing another exemplary cutter that can be used in the cutting printer shown in FIG. 1.
Figure 11B:
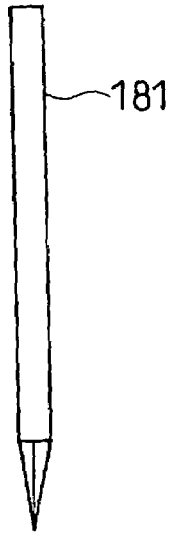
FIG. 11B is a side view showing the cutter shown in FIG. 11A.

FIG. 11A is a front view of another exemplary cutter 181 that can be used in the cutting printer 11. FIG. 11B is a side view of the cutter of FIG. 11A. The cutter 181 shown in FIGS. 1A and 1B is rectangular in cross section. The cutter 181 is not eccentric like the cutter 43 shown in FIG. 10 and has cutting edges 181*a* on both sides, so that cutter 181 is suitable for cutting a straight line.

Figure 12A:
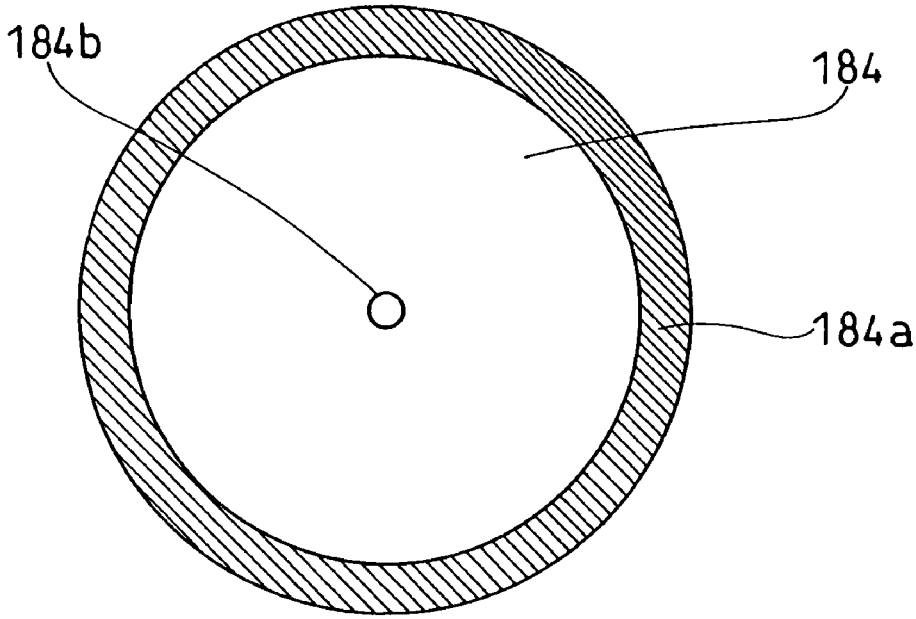
FIG. 12A is a front view showing another exemplary cutter that can be used in the cutting printer shown in FIG. 1.
Figure 12B:
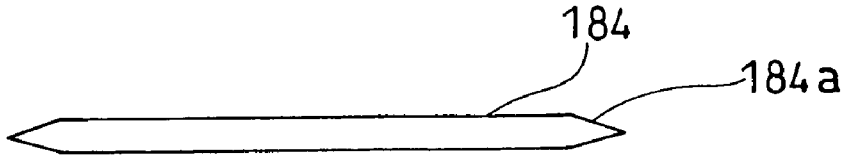
FIG. 12B is a side view showing the cutter shown in FIG. 12A.

Further, FIG. 12A is a front view of another exemplary cutter 184 that can be used in the cutting printer 11. FIG. 12B is a side view of the cutter of FIG. 12A. The cutter 184 shown in FIGS. 12A and 12B is discoid and has a cutting edge 184*a* on its periphery. The cutter 184 has a hole 184*b* in its center. The cutter 184 rotates and thus cuts a sheet while the cutter 184 is supported by a member that is inserted into the hole 184*b*.

Next, a control system of the label making apparatus according to the embodiment will be described with reference to FIG. 1.

The computer 110 includes a keyboard 141, a mouse 142, a main unit 130 and a display 132. The main unit 130 has a CPU 134, a RAM 136, and a ROM 138, which are connected to each other by a bus and are also connected to an I/O interface 140.

In the ROM 138, data on fonts of characters and figures is stored as well as programs such as editor software for making a label. The editor software is the software for printing an image on a sheet and cutting the sheet at a desired position. By using the editor software, a user can input and edit a content of an image to be printed on a sheet or a cutting position using the keyboard 141 or the mouse 142 while observing the display 132.

The CPU 134 performs a predetermined operation based on the programs and data read from the ROM 138 and data provided from the cutting printer 11. The RAM 136 temporarily stores operation results of the CPU 134.

An I/O interface 112 of the cutting printer 11 is connected to the I/O interface 140 of the personal computer 110. Further, a head drive circuit 120 that drives the thermal head 44 (see FIGS. 2 and 3), motor drive circuits 122, 124 that drive the first drive motor 21 and the second drive motor 35 (see FIG. 3) are connected to the I/O interface 112 in addition to a CPU 114, a ROM 116, and a RAM 118.

In the ROM 116, necessary data is stored as well as a program that controls operation of the cutting printer 11. The CPU 114 performs the predetermined operation based on the program and the data read from the ROM 116 and the data provided from the personal computer 110 and sends control signals to the head drive circuit 120. The RAM 118 temporarily stores the data provided from the personal computer 110 and the operation results of the CPU 114.

Figure 13:
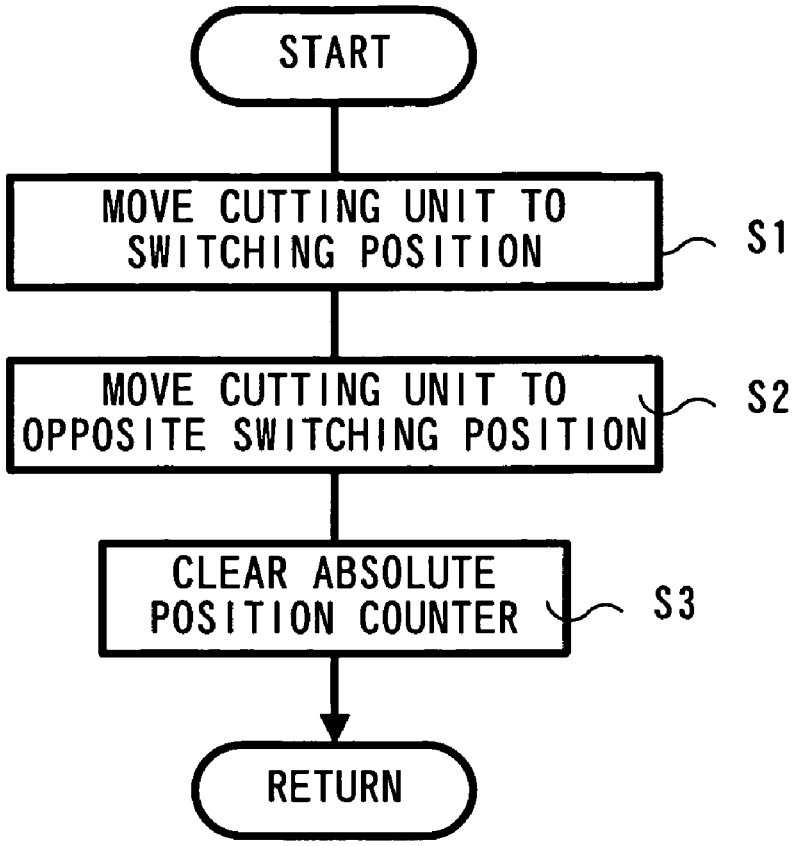
FIG. 13 is a flowchart showing schematic steps for making a label according to an exemplary embodiment of the invention.
Figure 14:
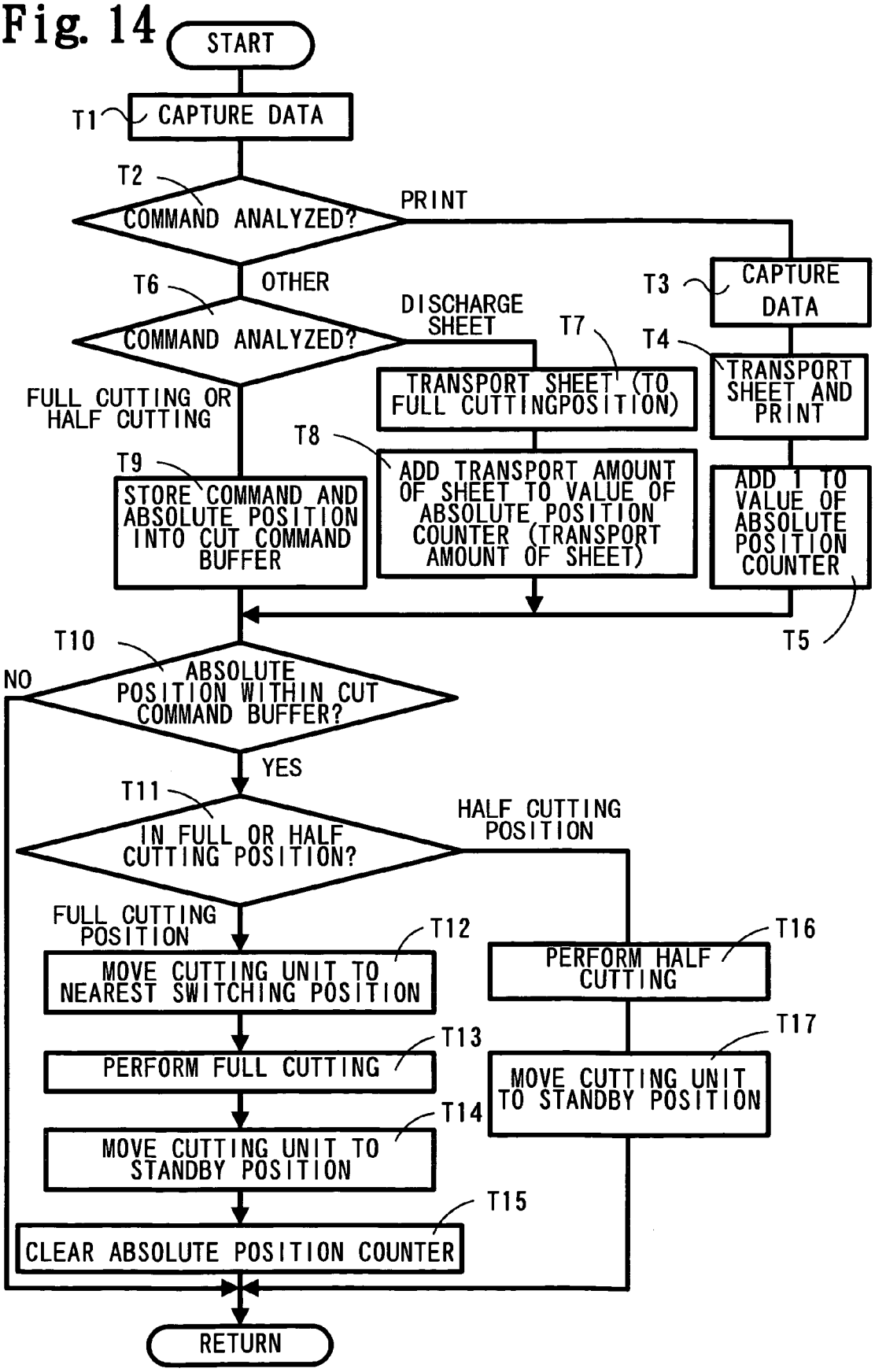
FIG. 14 is a flowchart showing schematic steps for making a label according to an exemplary embodiment of the invention.
Figure 15:
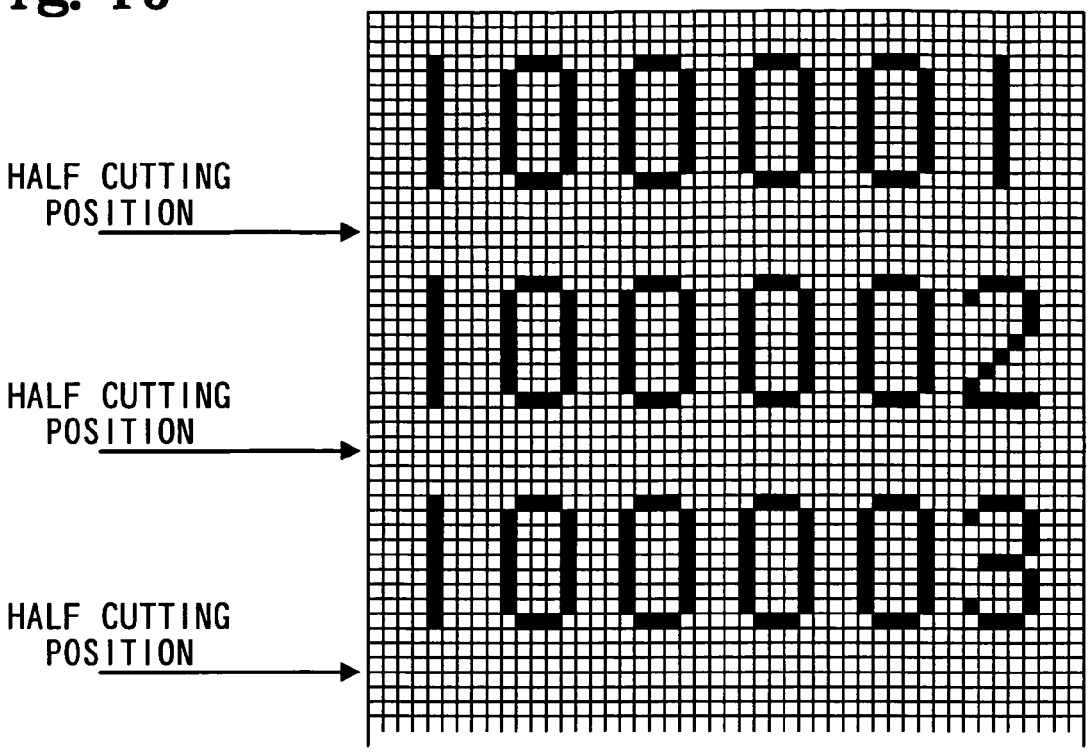
FIG. 15 is a schematic diagram of a plurality of labels made by an exemplary embodiment of the invention.
Figure 15:
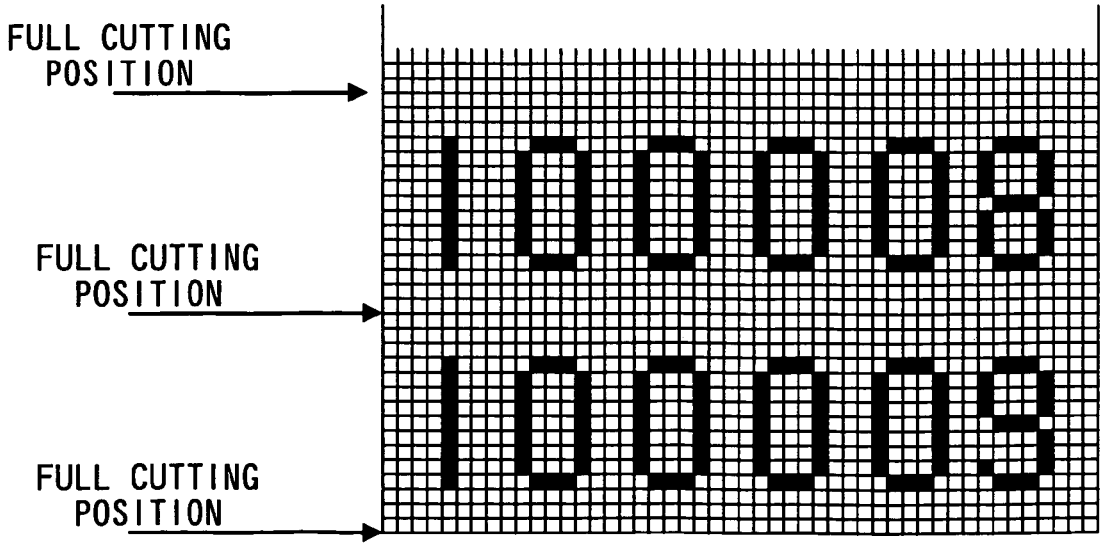
Figure 17:
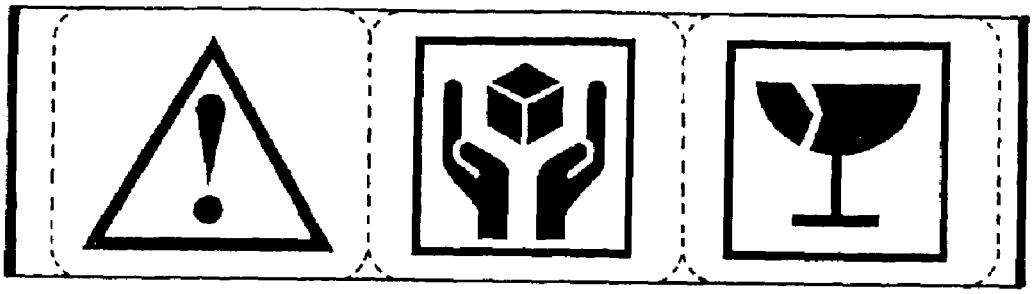
FIG. 17 is a schematic diagram of a plurality of labels made by an exemplary embodiment of the invention.

Next, a detailed procedure for making a label using the label making apparatus 100 according to the embodiment will be described with reference to FIGS. 13 through 17. FIGS. 13 and 14 are flowcharts showing schematic steps for making a label using the label making apparatus 100 according to an exemplary embodiment. FIG. 13 is a flowchart showing an initialization of the cutting unit in the cutting printer 11. FIG. 14 is a flowchart showing a printing and cutting operation in the cutting printer 11. FIGS. 15 and 17 are schematic diagrams of labels made by the exemplary embodiment. In FIGS. 15 and 17, a thick line indicates a full cut line and a dashed line indicates a half cut line. FIG. 16 illustrates contents of data to be used for making a strip of label shown in FIG. 15.

FIG. 15 shows a strip of label including nine labels (some labels are omitted) that are numbered from "100001" to "100009" and are separated from each other by half cut lines as demarcation lines. FIG. 17 shows a strip of labels including three labels on which different images are printed and are separated by half cut lines as the demarcation lines. As is understood from these drawings, these strips of labels are made by performing a plurality of half cuttings on the tack sheet 13 before a full cutting is performed. The label making apparatus 100 of the embodiment can make not only labels shown in FIGS. 15 and 17 but also a label which has no half cut line or a label on which a half cutting is performed only once before a full cutting is performed. Hereinafter, a procedure for making labels will be described, including the exemplary embodiments described above.

First, an initialization of the cutting printer 11 will be described with reference to FIG. 13. When power of the cutting printer 11 is turned on, at step S1, the cutting unit 30 moves to either right or left switching position, for example, to the nearest switching position. Therefore, it is guaranteed that the cutting unit 30 is in a full cutting state shown in either FIG. 7 or 8.

Next, at step S2, the cutting unit 30 moves to a standby position adjacent to the wall opposed to the present position. Thus, the cutting unit 30 is switched to a half cutting state. Then, at step S3, an absolute position counter stored in the RAM 118 is initialized to zero. The absolute position counter counts a transport amount of the tack sheet 13 per dot, as described later.

As a user enters commands to the editor software installed in the personal computer 110, the cutting printer 11 performs printing and cutting. That is, the user enters contents to be printed onto a label or shape data (a full cutting position and a half cutting position) while observing the indication on display 132 displayed by the editor software. The entered data is stored in the RAM 136. Then, after the data entry as to the label is completed, at step T1, a string of data is captured by the cutting printer 11 one after another.

An exemplary embodiment of the string of data is shown in FIG. 16. The data shown in FIG. 16 is data after the leading edge of the tack sheet 13 is set to a predetermined starting position. In FIG. 16, P, H, and F in a first column each indicate a print command, a half cutting command, and a full cutting command, respectively. Six pieces of hexadecimal data, such as "00" and "1C", in second rough seventh columns provided in the next of the print command indicates on and off of each dot group. The dot group is formed by dividing dots included in one dot line every eight dots. Further, hexadecimal data in the second to fourth columns provided in the next of the half cutting command and the full cutting command indicates a place of a dot where a half cutting or a full cutting is to be performed. The place of the dot is counted from the leading edge of the tack sheet 13 in the transport direction of the tack sheet 13.

The data shown in FIG. 16 shows that a plurality of half cuttings are performed on a sheet before a full cutting is performed on the printed sheet in the cutting printer 11.

Then, at step T2, a command in the first column of each line of the captured data from the personal computer 110 is analyzed by the CPU 114. As a result, when the analyzed command is not the print command, flow proceeds to step T6. When the analyzed command is the print command, flow proceeds to step T3, and the data in the second through seventh columns in the print command line are captured from the personal computer 110 and are stored in the RAM 118.

Then, at step T4, according to the data stored in the RAM 118, the tack sheet 13 is transported and one dot line is printed. That is, the first drive motor 21 is driven by the motor drive circuit 122 and thus the platen roller 24 and the discharge roller 25 transports the tack sheet 13. Heating elements of the thermal head 44 are applied electric current, so that the heating elements generate heat. Therefore, the tack sheet 13 disposed between the thermal head 44 and the platen roller 24 pigments, whereby a predetermined image is formed on the tack sheet 13. Next, at step T5, one is added to a count value of the absolute position counter, and then flow proceeds to step T10.

At step T6, as is the case with step T2, a command in a first column of one dot line of the captured data from the personal computer 110 is analyzed. As a result, when the analyzed data is a move command, flow proceeds to step T7. When the analyzed data is the full cutting command or the half cutting command, flow proceeds to step T9.

At step T7, the first drive motor 21 is driven by the motor drive circuit 122, and thus the tack sheet 13 is transported to the absolute position stored in a cutting command buffer at step T9 where the full cutting is performed. Therefore, when the full cutting is performed at step T13, a strip of printed label including a plurality of labels connectedly separated by half cut lines each other is discharged. Next, at step T8, the transport amount of the sheet at step T7 is added to the count value of the absolute position counter, and then flow proceeds to step T10.

At step T9, the half cutting command or the full cutting command is stored in the cutting command buffer of the RAM 118 with the absolute position, and then flow proceeds to step T10.

Next, at step T10, the present count value of the absolute position counter is determined as to whether it is within the absolute position of the half cutting command or the full cutting command stored in the cutting command buffer at step T9. When it is within the absolute position, flow proceeds to step T11. When it is out of the absolute position, flow returns to the start.

At step T11, the present count value of the absolute counter is determined as to whether it is in the half cutting position or the full cutting position which is stored in the cutting command buffer at step T9. As a result, when it is the full cutting position, flow proceeds to step T12. When it is the half cutting position, flow proceeds to step T16.

At step T12, in order to perform the full cutting, the cutting unit 30 is moved to the nearest switching position and is switched from the half cutting state to the full cutting state. At this time, because the two large-diameter balls 156 and 157 that achieve the full cutting state exist on both sides of the small-diameter ball 158 that achieves the half cutting state as shown in FIGS. 6 though 9, switching from the half cutting state to the full cutting state can be performed at the nearest switching position no matter where the cutting unit 30 is located. Therefore, a time involved in making a label can be reduced.

Then, at step T13, the cutting unit 30 is moved to the full cutting position and fully cuts the tack sheet 13. After the full cutting is performed, at step T14, the cutting unit 30 is moved to the standby position and is switched to the half cutting state. After that, at step T15, the absolute position counter is cleared and flow returns to the start.

At step T16, the cutting unit 30 is moved to the cutting position and half cuts the tack sheet 13. After the half cutting is performed, at step T17, the cutting unit 30 is moved to the standby position. While the cutting unit 30 is kept in the half cutting state, flow returns to the start.

With such a procedure, the labels connected by the half cut lines shown in FIG. 15 can be obtained by performing the half cutting at least twice on the tack sheet 13 before performing the full cutting, using the exemplary label making apparatus 100 of the invention. Therefore, when making a plurality of labels whose printed contents are related to each other, like the serially numbered labels shown in FIG. 15, a strip of labels that is convenient to handle can be obtained without coming apart. Further, according to the exemplary embodiment, a strip of labels including a plurality of labels that are continuously connected to each other by half cut lines without wasted portions therebetween can be obtained. Therefore, waste of the sheet can be prevented.

To make a curved half cut line as shown in FIG. 17, the tack sheet 13 is transported while the cutting unit 30 is moved by driving the second drive motor 35 with the first drive motor 21. That is, the normal and reverse rotation of the first drive motor 21 and the second drive motor 35 are appropriately combined and simultaneously performed, and thus a portion on the tack sheet 13 where a predetermined image is formed can be full or half cut to any shape.

In the label making apparatus 100 of the exemplary embodiment, the full cutting and the half cutting are performed using one cutter 43 by switching the state of the cutter 43. Therefore, only one drive source is needed for the cutter 43, so that the structure of the label making apparatus 100 can be simplified. In addition, the full cutting and the half cutting are performed at the same position, so that the control, such as stopping the sheet when cutting, can be performed with relative ease.

Next, another exemplary embodiment of the switching mechanism for switching the state of the cutter between the half cutting state and the full cutting state in the label making apparatus of the invention will be described with reference to FIG. 18. In this embodiment, switching between the half cutting state and the full cutting state is achieved by vertically changing a position of guides that are to be contacted by a cutter.

Figure 18A:
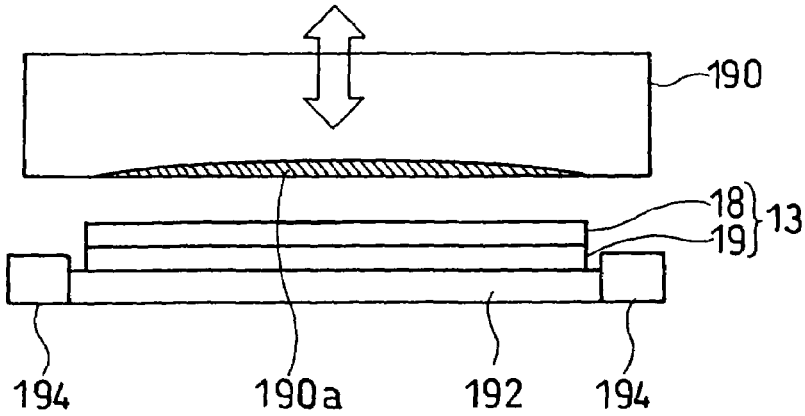
FIG. 18A is a diagram showing another exemplary embodiment of a switching mechanism that switches a state of a cutter between a half cutting state and a full cutting state.

As shown in FIG. 18A, a cutter 190 used in this embodiment has a flat plate shape, and is provided with a cutting edge 190*a* at its bottom along a longitudinal direction. The cutter 190 is supported so that the cutter 190 can move vertically as shown by an arrow. The tack sheet 13 that is to be cut and is formed by laminating the adhesive sheet 18 and the releasable sheet 19 is placed on a sheet table 192. On both sides of the sheet table 192, vertically movable guides 194 are provided. The guides 194 are allowed to take either a half cutting position, which is an upper position, or a full cutting position, which is a lower position. Each guide 194 is disposed at a position opposed to the edge of the cutter 190 where the cutting edge 190*a* is not provided.

Figure 18B:
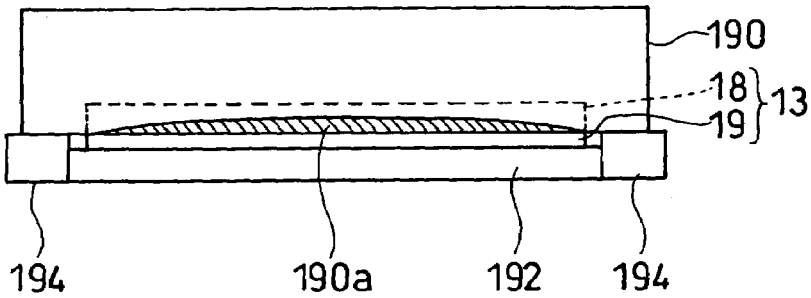
FIG. 18B is a diagram showing the switching mechanism when the cutter is in the half cutting state.

To put the cutter 190 into the half cutting state, as shown in FIG. 18B, the guides 194 are set to the half cutting position. Thus, the edge of the cutter 190 contacts the guides 194 when the cutter 190 is moved to the lower position, so that the cutter 190 cannot move downward farther than a position where the cutter 190 can cut only the adhesive sheet 18 of the tack sheet 13.

Figure 18C:
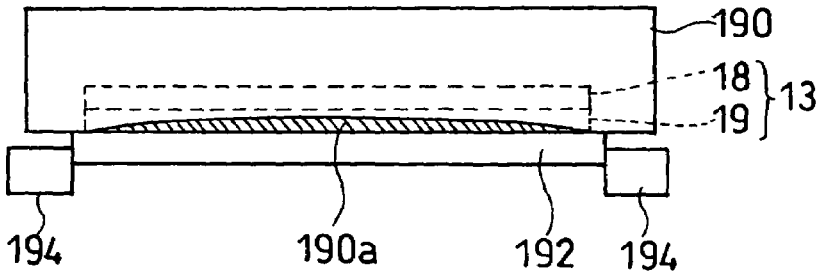
FIG. 18C is a diagram showing the switching mechanism when the cutter is in the full cutting state.

On the other hand, to put the cutter 190 into the full cutting state, as shown in FIG. 18C, the guides are set to the full cutting position. Thus, the edge of the cutter 190 do not contact the guides 194 even when the cutter 190 is moved to the lowermost position, so that the cutter 190 can cut both the adhesive sheet 18 and the releasable sheet 19 of the tack sheet 13.

Accordingly, the label making apparatus having the structure like this embodiment can speedily perform the full cutting and the half cutting when the tack sheet 13 is cut along its width direction.

Various exemplary embodiments of the invention have been described. However, it is to be understood that the invention is not restricted to the particular forms shown in the foregoing exemplary embodiments. Various modifications and alternations can be made thereto. For example, in the aforementioned exemplary embodiments, the label making apparatus 100 includes the cutting printer 11 and the personal computer 110. However, the label making apparatus 100 may include only the cutting printer 11 that has all functions of the personal computer 110. Further, in the aforementioned exemplary embodiments, the full cutting and the half cutting are performed along the width direction of the tack sheet 13. However, the half cutting may be performed surrounding a character printed on the tack sheet 13.

What is claimed is:

1. A label making apparatus having side walls that makes labels by performing a full cutting and a half cutting on a sheet, comprising:

a cutter disposed between the side walls of the apparatus comprising a single cutting blade that cuts the sheet along a desired line;

a switching device coupled to the cutter that switches a state of the cutter between a full cutting state and a half cutting state by moving the cutter from a first position to a second position via contact of the switching device and one of the side walls of the apparatus, the cutter performing the full cutting on the sheet in the full cutting state, and the half cutting on the sheet in the half cutting state, wherein, in the half cutting state, the sheet is cut partway in a direction of a thickness of the sheet; and a motor unit that moves the switching device to switch the state of the cutter between the full cutting state and the half cutting state by moving the switching device to a cutting state selection position based on proximity to the side wall of the apparatus; and a controller that communicates with the motor unit to control the switching device so that the half cutting is performed at least twice on the sheet before the full cutting is performed thereon.

2. The label making apparatus according to claim 1, wherein the cutter and the switching device are part of a self-propelled cutting unit, the state of the cutter can be switched between the full cutting state and the half cutting state at ends of a traveling path of the self-propelled cutting unit, the switching device takes selectively one of at least three positions and achieves one of the full cutting state and the half cutting state commonly at at least two positions of the at least three positions, each of the at least two positions where the switching device commonly achieves the one of the full cutting state and the half cutting state existing on both sides of another position respectively and in a line parallel to the traveling path, the switching device achieving another of the full cutting state and the half cutting state at the another position.

3. The label making apparatus according to claim 2, wherein the switching device achieves the full cutting state at the at least two positions and each of the at least two positions where the switching device achieves the full cutting state exists on both sides of the another position where the switching device achieves the half cutting state.

* * * * *